US011542641B2

(12) United States Patent
Atmanspacher

(10) Patent No.: US 11,542,641 B2
(45) Date of Patent: Jan. 3, 2023

(54) KNITTED ARTICLE

(71) Applicant: medi GmbH & Co. KG, Bayreuth (DE)

(72) Inventor: Jan Atmanspacher, Warmensteinach (DE)

(73) Assignee: MEDI GMBH & CO. KG, Bayreuth (DE)

( * ) Notice: Subject to any disclaimer, the term of this patent is extended or adjusted under 35 U.S.C. 154(b) by 0 days.

(21) Appl. No.: 15/921,845

(22) Filed: Mar. 15, 2018

(65) Prior Publication Data

US 2018/0266023 A1 Sep. 20, 2018

(30) Foreign Application Priority Data

Mar. 15, 2017 (EP) ..... 17161017

(51) Int. Cl.

| | |
|---|---|
| ***D04B 1/04*** | (2006.01) |
| ***D04B 1/26*** | (2006.01) |
| ***D04B 9/12*** | (2006.01) |
| ***D04B 9/22*** | (2006.01) |

(52) U.S. Cl.

CPC ..... *D04B 1/04* (2013.01); *D04B 1/26* (2013.01); *D04B 9/12* (2013.01); *D04B 9/22* (2013.01)

(58) Field of Classification Search

CPC . D04B 1/26; D04B 9/12; D04B 11/08; D04B 9/22

USPC ..... 66/182, 185, 172 R

See application file for complete search history.

(56) References Cited

U.S. PATENT DOCUMENTS

| | | | | |
|---|---|---|---|---|
| 2,379,852 | A * | 7/1945 | Nebel | D04B 1/02 66/194 |
| 4,255,949 | A * | 3/1981 | Thorneburg | A41B 11/00 2/239 |
| 4,732,015 | A | 3/1988 | Abrams et al. | |
| 5,335,517 | A | 8/1994 | Throneburg et al. | |
| 5,603,232 | A * | 2/1997 | Throneburg | A41B 11/02 2/239 |
| 6,230,525 | B1 * | 5/2001 | Dunlap | D04B 1/26 66/178 R |
| 7,677,061 | B2 * | 3/2010 | Mori | A41B 11/02 66/185 |
| 8,424,116 | B2 * | 4/2013 | Anastsopoulos | A41B 11/003 2/239 |
| 8,973,411 | B2 * | 3/2015 | Gaither | A61F 13/08 66/182 |
| 2008/0189824 | A1 * | 8/2008 | Rock | D04B 1/02 2/69 |
| 2013/0205839 | A1 * | 8/2013 | Fukui | D04B 1/02 66/185 |

FOREIGN PATENT DOCUMENTS

| | | | |
|---|---|---|---|
| EP | 1997394 | A1 | 12/2008 |
| EP | 2628831 | A1 | 8/2013 |
| WO | 2006002371 | A2 | 1/2006 |

* cited by examiner

*Primary Examiner* — Danny Worrell

(74) *Attorney, Agent, or Firm* — Lucas & Mercanti, LLP; Klaus P. Stoffel

(57) ABSTRACT

A knitted article, having a basic knitted fabric which is knitted from at least one basic knitted fabric thread, and at least two plush threads which are plated on the basic knitted fabric thread and which configure first and second plush loops, wherein the first and the second plush loops have dissimilar heights.

20 Claims, 2 Drawing Sheets

KNITTED ARTICLE

CROSS-REFERENCE TO RELATED APPLICATIONS

The present application claims priority of EP 17 161 017.3, filed Mar. 15, 2017, the priority of this application is hereby claimed and this application is incorporated herein by reference.

BACKGROUND OF THE INVENTION

The invention relates to a knitted article, having a basic knitted fabric which is knitted from at least one basic knitted fabric thread, and at least two plush threads which are plated on the basic knitted fabric thread and which configure first and second plush loops.

Such a knitted fabric is known, for example, from EP 1 997 394 A1. In the case of the knitted article in the form of a stocking disclosed therein, a pronation support and at least one damping zone which can comprise a knitted plush fabric are provided on the knitted fabric side. This knitted plush fabric can be formed from a plush thread which has a lower yarn count, that is to say is thicker, than a second plush thread from which a knitted plush fabric of a plush portion that is adjacent to the region of the pronation support or to the damping zone is formed. On account of the use of such a thicker plush thread in the region that forms the pronation support or the damping zone, respectively, the supporting effect of the pronation support, and the damping effect of the damping zone, can be set or improved respectively, in particular as compared to the plush portion that is knitted from a thinner plush thread.

The local properties of the knitted article are thus influenced here by way of the configuration of plush loops from dissimilarly thick plush threads. The different portions in which the different plush loops are present are separated from one another in the case of the known knitted article.

SUMMARY OF THE INVENTION

The invention is based on the object of specifying a knitted article that is improved as compared to said known knitted article.

In order for this object to be achieved, it is provided according to the invention in the case of a knitted article of the type mentioned at the outset that the first and the second plush loops have dissimilar heights.

It is provided according to the invention that two different plush loop shapes are formed from two separate plush threads, wherein the two plush loop shapes differ in terms of height. This means that the plush loops of the first shape are higher or longer than the plush loops of the second shape, and the first plush loops consequently project somewhat further from the plane of the basic knitted fabric than the second plush loops. This leads quasi to a multiple-layered construction, or a construction having multiple planes, resulting on the knitted article according to the invention. The first layer, or the first plane, herein forms the basic knitted fabric which is embodied, for example, as a right/left knitted fabric. The second layer or plane forms the shorter plush loops which project somewhat from the plane of the basic knitted fabric, while the third layer or plane form the longer plush loops which project further from the plane of the basic knitted fabric and also protrude beyond the first plane of plush loops. On account thereof it is possible for a plush zone to be knitted from the first plush thread, having the first plush loops, and the other zone to be knitted from the second plush thread, having the second plush loops, when dissimilar and mutually separate plush zones are knitted, wherein these plush zones differ in terms of the damping or cushioning properties thereof, or in terms of other properties, depending on which types of plush threads are used.

However, it is particularly expedient when one or a plurality of zones are formed in which first and second plush loops are collectively present such that the triple-plane or triple-layer construction quasi results within the zone. In this case, a respective knitted article property which is perceived by the wearer as pleasant or advantageous, for example in terms of damping, thermal effect, etc., can be set, for example, by way of the longer plush loops which project the furthest on the left knitwear side and consequently bear directly on the skin. A second property of the knitted article, for example the dissipation of moisture from the knitted article by virtue of the capillary effect and due to the fact that the plush loops are routed through the right knitwear side can be influenced or set by way of the second plane of the shorter plush threads that lies below said longer plush loops. The third plane forms the basic knitted fabric. For example, an optimized climatic management in conjunction with a pleasant haptic perception or a pleasant wearing comfort, respectively, can consequently be achieved on account of the configuration of this triple-layer or triple-plane construction having the two dissimilar plush loop layers or plush loop planes.

The plush loops from both threads are usually formed by means of a sinker which has a single dimension. That is to say that the spacing between the basic knitted fabric thread and the first and the second plush loops directly after knitting is identical. On account of a post-treatment, in particular a thermal treatment, the one thread shrinks such that the plush loops knitted therefrom are shortened, while the other thread and thus the plush loops knitted therefrom almost maintain the length thereof. If knitting using different sinkers is possible, the various plush loops can be formed directly when knitting, without any post-treatment.

Although only two different plush threads can be knitted in the simplest case for forming two plush loops of dissimilar lengths and thus forming two distinctive planes, it is possible for a third or a fourth plush thread to also be used in order for further planes to be formed by forming further plush loops which in turn have other lengths. These plush threads in comparison to the first and second plush threads can display a somewhat other shrinking behavior such that the different loop lengths can be obtained in the context of the post-treatment.

Although advantageous properties can be achieved already by the configuration of dissimilar plush loop planes from indeed separate threads which however are of the same type, a particularly advantageous configuration provides that the two plush threads are composed of dissimilar materials and/or have dissimilar properties. Different plush threads which are either composed of dissimilar materials such as, for example polyamide in the one case and a natural fiber such as wool in the other case, are therefore preferably used, said threads however, alternatively or additionally, also potentially having dissimilar properties, wherein this in an exemplary but not exhaustive manner includes, for example, dissimilar shrinking behaviors in the case of a thermal treatment, and/or dissimilar elasticities, and/or dissimilar surfaces, and/or dissimilar thicknesses. On account of this potential for variation in terms of the plush threads used and of the materials and properties thereof, respectively, there is thus a high degree of flexibility and thus also of variability in terms of the settings of the functionality of the different plush loop planes or plush loop layers. The focus of knitted articles of this type herein is in particular a pleasant cushioning, consequently a pleasant wearing comfort, in conjunction with a positive climatic management or a climatic control, respectively, in order to avoid excessive sweating. This can be achieved, for example, in that the one plush thread by way of which the shorter plush loops are knitted is from PA (polyamide), while the other plush thread from which the longer plush loops are knitted is from a natural fiber, in particular wool, or else silk. A plush thread that is composed of a man-made fiber displays a low tendency toward absorbing moisture, by virtue of the capillary effect is thus particularly expedient in terms of a transportation of moisture through the knitted article from the inside to the outside. In contrast, a natural thread, for example from wool, from which the longer or higher plush loops, respectively, which bear directly on the skin are formed, records by heat-retaining and temperature-equalizing properties, said natural thread being breathable and dirt and water repellent; the antibacterial properties of said natural thread can also be utilized, and the like. Threads of dissimilar thicknesses can also be used, such that the cushioning properties of the plush zone can be even further varied.

If a man-made fiber, in particular PA, is used, the plush thread can be textured and be highly elastic, and be embodied with or without a core. This means that a high degree of flexibility and variability is also provided in this context.

There are various possibilities for incorporating the plush threads and thus for configuring the plush loops. It is thus possible for the two plush threads to be incorporated in separate stitch courses of the basic knitted fabric. In this case, only first or only second plush loops are incorporated in each stitch course of the basic knitted fabric. Since the knitted article is preferably embodied as a circular knitted fabric, in which the stitch courses run in a helical manner, the term "stitch course" refers to a two-dimensional projection of the circular knitted fabric, this means that the circular knitted fabric is quasi-cut open and is viewed in a planar manner, each stitch course having a beginning and an end.

Various patterns or variations, respectively, are conceivable in terms of the stitch courses which are provided with the plush threads and thus with the plush loops. It can thus be provided according to a first alternative that the two plush threads are incorporated in successive stitch courses. This means that the first plush loops are incorporated in a first stitch course, the second plush loops are incorporated in the subsequent second stitch course, the first plush loops in turn are incorporated in the subsequent third stitch course, the second plush loops are again incorporated in the fourth stitch course, etc. Alternatively, it is conceivable that in each case at least one stitch course that is not provided with any plush thread is provided between the stitch courses. The first plush thread, or the first plush loop, respectively, here is thus knitted into a first stitch course, the second stitch course is not occupied by any plush thread, the third stitch course is provided with the second plush thread and thus with the second plush loop, the fourth stitch course in turn is not provided with any plush thread, while the fifth stitch course is provided with the first plush thread, etc.

Finally, it is also conceivable that a plurality of successive stitch courses that are provided with the first plush thread alternate with a plurality of successive stitch courses that are provided with the second plush thread, or at least one stitch course that is not occupied by any plush thread is provided between said respective successive stitch courses. A type of rib structure quasi results here, comprising mutually alternating narrow because only two or a few more stitch courses comprising dissimilar plush loop planes are provided. These dissimilar, narrow, or linear planes herein can directly alternate; however, it is also conceivable for one or a few stitch courses that are not occupied by plush threads to be provided between said planes.

It is to be noted at this point that the stitch courses are successive when viewed in the longitudinal direction of the knitted fabric, consequently are successive when viewed in the direction of the individual stitch wales.

Furthermore an alternative lies in how far the plush threads are incorporated in the basic knitted fabric, when viewed in the circumferential direction. Here, the plush thread profile, and thus the plush loop arrangement, perpendicular to the longitudinal direction of the knitted fabric, specifically in the circumferential direction of the respective stitch course, is now viewed. According to one design embodiment according to the invention it is thus conceivable that the plush threads run in each case helically through the basic knitted fabric. In the context of the projection described above, the plush thread thus runs from one end of the unwound knitted article to the other end. In the real knitted fabric, an annular plush zone that runs around the entire knitted article circumference is thus formed.

Alternatively hereto, it is conceivable that the plush threads in the respective stitch course run in the circumferential direction only in portions. Here, the plush threads, or the region in which the plush loops are configured, respectively, proceeding from the two-dimensional projection described above, thus only extend for a short stretch between the left and the right periphery of the unwound knitted article, consequently only across a limited number of stitch wales. In the context of the actual knitted article, a zone having plush loops that in the circumferential direction runs over less than 360° is configured, said zone on both sides being delimited by the basic knitted fabric. Consequently, while a quasi cylindrical plush zone results in the case of the first alternative, only a local plush zone results according to the second alternative.

Alternatively or additionally, it is conceivable for a plush or cushion portion, in which the first and the second plush thread are incorporated in the basic knitted fabric in each case in the same stitch course, in each case so as to run in portions in the circumferential direction, to be provided on the knitted article. While the individual stitch courses in the design embodiment described above are provided with only the one or the other plush thread, in this design embodiment both plush threads are in each case knitted in a common stitch course, this meaning that first and second plush loops are provided in the stitch course. It is accordingly also possible for the first and the second plush loops to be either knitted in a mutually alternating manner, or to be knitted without occupied loops therebetween, or for a plurality of portions that are formed from the first and the second plush threads to mutually alternate, when viewed in the circumferential direction, wherein each portion is composed of two or more first or second plush loops, wherein the respective number of plush loops should not be excessive. A rib structure is thus likewise configured here, however when viewed in the circumferential direction.

Since the plush or cushion zone naturally extends across a plurality of stitch courses in the longitudinal direction of the knitted fabric, various design embodiments are conceivable in terms of the arrangement of the first and the second plush loops in relation to the individual stitch wales. It can thus be provided that the first and the second plush loops at least in part lie in common stitch wales. This means that both first as well as second plush loops are present in one stitch wale, for example so as to be mutually alternating or so as to be spaced apart from each other in the direction of the stitch wales by way of respective empty stitches, or in the form of individual stitch wale portions, wherein each stitch wale portion comprises two or more first or two or more plush loops, etc. Alternatively thereto, it is also conceivable that the first and the second plush loops lie so as to be mutually offset and in different stitch wales. Consequently, in the case of this alternative, the plush loops when viewed in the circumferential direction are not knitted on each needle; rather, at least one empty stitch in which the respective plush thread lies so as to be a floating thread or a catch thread is provided, such that a corresponding offset can be configured from one stitch course to another, or from one stitch wale to another, respectively.

Depending on how the plush loop arrangement that is predefined by the knitting pattern is now specifically chosen, there are further potential variations in terms of the number or the density, respectively, of the respective dissimilar plush loops. The number of the first plush loops and the number of the second plush loops thus can be substantially identical; alternatively, the number of first and the number of second plush loops can also be dissimilar. This means that there is the possibility of knitting the plush loop planes or the plush loop layers either with the same density, or with dissimilar densities, such that arbitrary variations are provided, depending on the desired property of the knitted article in terms of the dissipation of moisture and of thermal properties. Besides the number by way of which the density can be varied, a variation in terms of density can of course also be achieved by using plush threads of dissimilar thicknesses.

An expedient but by no means limited embodiment provides that the one plush thread is knitted in the form of a 2:1 plush, and the other plush thread is knitted in the form of a 1:2 plush. For example, the lower, shorter plush loops can be knitted as a 2:1 plush, that is to say that two plush stitches and an empty stitch in which the plush thread is only placed into the basic knitted fabric are performed. The second knitted fabric thread from which the higher or longer plush loops are formed, can be knitted as a 1:2 plush. Here, one plush stitch is performed, followed by two empty stitches where the plush thread is thus only placed into the basic knitted fabric.

Two different design embodiments are conceivable in terms of the multiple-layer or multiple-plane construction of the knitted article in the region of the plush or cushion zone. According to a first alternative of the invention, the first and the second plush loops can project toward the same side of the basic knitted fabric. Said first and second plush loops thus both extend to the left knitted goods side, thus toward the side that in the worn position faces the wearer. Alternatively, it is also conceivable that the first plush loops project toward the one side of the basic knitted fabric, and the second plush loops project toward the other side of the basic knitted fabric.

In order to impart a certain elasticity to the knitted article, it is expedient for at least one weft thread to be inserted into the basic knitted fabric. This weft thread runs as a floating thread and a catch thread through the stitches of the basic knitted fabric. Said weft thread is composed of an adequately elastic material, for example elastane, and can be used with or without a wrapping.

It is expedient herein when the weft thread is inserted at least in those stitch courses in which the plush thread that forms the lower plush loops is incorporated. For example, if the stitch courses in which the first and the second plush thread, and thus the first and the second plush loops, are incorporated mutually alternate in the longitudinal direction of the knitted fabric, the weft thread is thus inserted into each second stitch course in which the plush thread that configures the shorter plush loops is incorporated, and runs as a catch thread and a floating thread through the individual stitch courses of the basic knitted fabric. This has the effect that the weft thread, when the latter on account of the stitches onto which the shorter plush loops are plated is inserted as a catch thread, pulls the plush thread inward into the basic knitted fabric. The weft thread is thus inserted as a catch thread into the plush loops, and pushes the shorter plush loops into the basic knitted fabric. This is advantageous for that particular thread that forms the shorter plush loops, and when the knitted plush loops thus serve for transporting moisture.

The knitted article per se can be embodied, for example, as a stocking, wherein the plush loops form an at least local cushion. It is obvious that the plush loops can be knitted at arbitrary locations on the stocking, for example in the region of the sole of the foot, for example where the focus, besides cushioning, is in particular on the transportation of moisture. In contrast, the focus in the region of the heel, for example, in the transition to the Achilles tendon is more on the cushioning than on the transportation of moisture. All these different properties can be readily varied and set on account of the variation provided according to the invention in terms of the plush threads used and of the plush loop lengths and of the plush loop densities, etc.

Besides the knitted article per se, the invention furthermore relates to a method for producing such a knitted article. This method is distinguished in that a basic knitted fabric is knitted using at least one basic knitted fabric thread, at least two plush threads being knitted into said basic knitted fabric while forming first and second plush loops, wherein either the first and the second plush loops are knitted so as to be of dissimilar heights, or wherein the first and the second plush loops are knitted so as to be of identical height and the knitted fabric subsequently is post-treated such that the one plush thread shrinks while shortening the plush loops that are knitted therefrom.

According to the invention, in the context of the production, the respective first and second plush threads are knitted while forming the first and the second plush loops when knitting the basic knitted fabric. According to the first alternative, the first and the second plush loops are knitted ex works, already during the knitting process, so as to have dissimilar lengths or heights. The finished knitted article thus already displays the multiple-layer or multiple-plane construction. Alternatively thereto, there is the potential for knitting the first and the second plush loops so as to have identical lengths when knitting the knitted article, thus while using the same sinker. The different plush loop lengths are thereafter generated in the context of a post-treatment in that the one plush thread shrinks on account of this post-treatment, while the other plush thread almost maintains the shape thereof. In the case of this design embodiment of the invention, a first and a second plush thread are consequently used, said first and second plush thread in terms of the shrinking behavior thereof being modified under the influence of respective environmental conditions. In the context of this post-treatment, the one plush thread, and thus the plush loops formed therefrom, is/are consequently shortened, while the other plush thread, and thus the plush loops formed therefrom, retains/retain the original length thereof.

The post-treatment of the knitted fabric can be, for example, a thermal treatment, in particular by means of warm or hot water or steam, meaning that the knitted article knitted is washed or steam-treated, for example, wherein the treatment temperature is carried out at or above the temperature at which the one plush thread shrinks. Alternatively, it is also conceivable for a post-treatment to be performed by radiation, in particular using UV light. A type of thermal treatment can also be achieved by way of this UV light, since the dissimilar threads absorb the UV light in dissimilar ways. It is also conceivable that the radiation alone, for example using UV light, influences or modifies, respectively, the material properties of the one plush thread such that the latter shrinks or is shortened, respectively.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
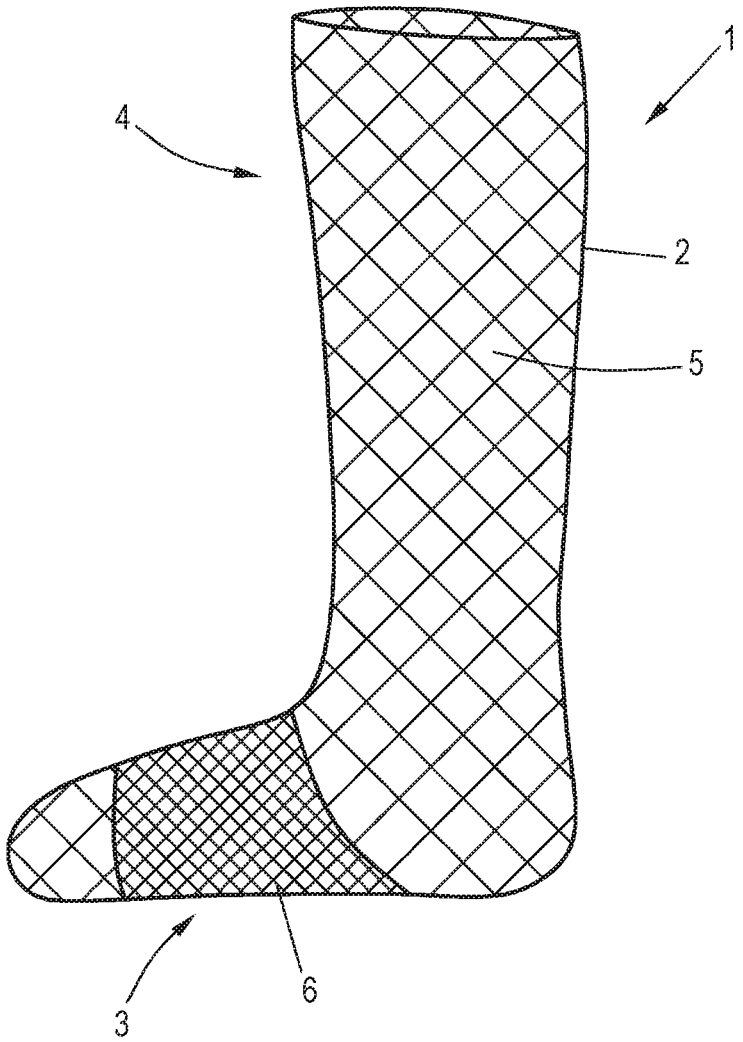
FIG. 1 shows an in-principle illustration of a knitted article according to the invention, in the form of a stocking.

FIG. 1 shows a knitted article 1 according to the invention in the form of a stocking 2, having a foot portion 3 and a calf portion 4.

The stocking 2 is composed of a basic knitted fabric 5 which here is illustrated by way of the hatched lines of lesser density. A plush or cushion zone 6 is configured in the foot region 3, in that two dissimilar plush threads which form plush loops of dissimilar length are additionally knitted into the basic knitted fabric 5. The plush or cushioning region 6 here, in an exemplary manner, is illustrated so as to encircle the stocking body in an annular or cylindrical manner. Of course, there is also the possibility of configuring this plush or cushioning region 6 in only a local manner.

Since the plush loops that are knitted from the two dissimilar plush threads are of dissimilar length, a triple-layer or triple-plane construction is consequently provided in this plush or cushioning region 6, specifically the plane of the basic knitted fabric 5, on the one hand, then the plane that is formed by way of the shorter plush loops, and finally the plane formed by way of the long plush loops. In conjunction with a variation of the number of first and second plush loops, the properties of the plush or cushioning region can be set or varied, respectively, in wide ranges by way of the plush threads used, which in particular are dissimilar and are composed of dissimilar materials, and/or have dissimilar properties such as dissimilar shrinking behaviors, dissimilar elasticities, dissimilar surfaces, and/or dissimilar thicknesses.

The plush or cushioning region 5 is preferably embodied such that said plush or cushioning region 5 offers a pleasant cushioning in haptic terms, on the one hand, and enables a positive discharge of moisture, or a good transportation of moisture, respectively, through the knitted article to the outside, on the other hand. This is achieved in that the longer plush loops which thus project the furthest from the plane of the basic knitted fabric and which bear on the skin of the wearer, are knitted from a natural thread such as wool or silk, for example. The plush loops which are shorter and in terms of the focal points serve for transporting moisture, are knitted from a man-made fiber such as PA, for example, and preferably lie as an intermediate layer between the basic knitted fabric layer or basic knitted fabric plane and the layer or the plane of the longer plush loops. If a weft thread is additionally used, which as a catch thread lies in the shorter plush loops, the latter are thus additionally pushed somewhat into the basic knitted fabric, this being advantageous in terms of the transportation of moisture through the basic knitted fabric to the outside.

Figure 2:
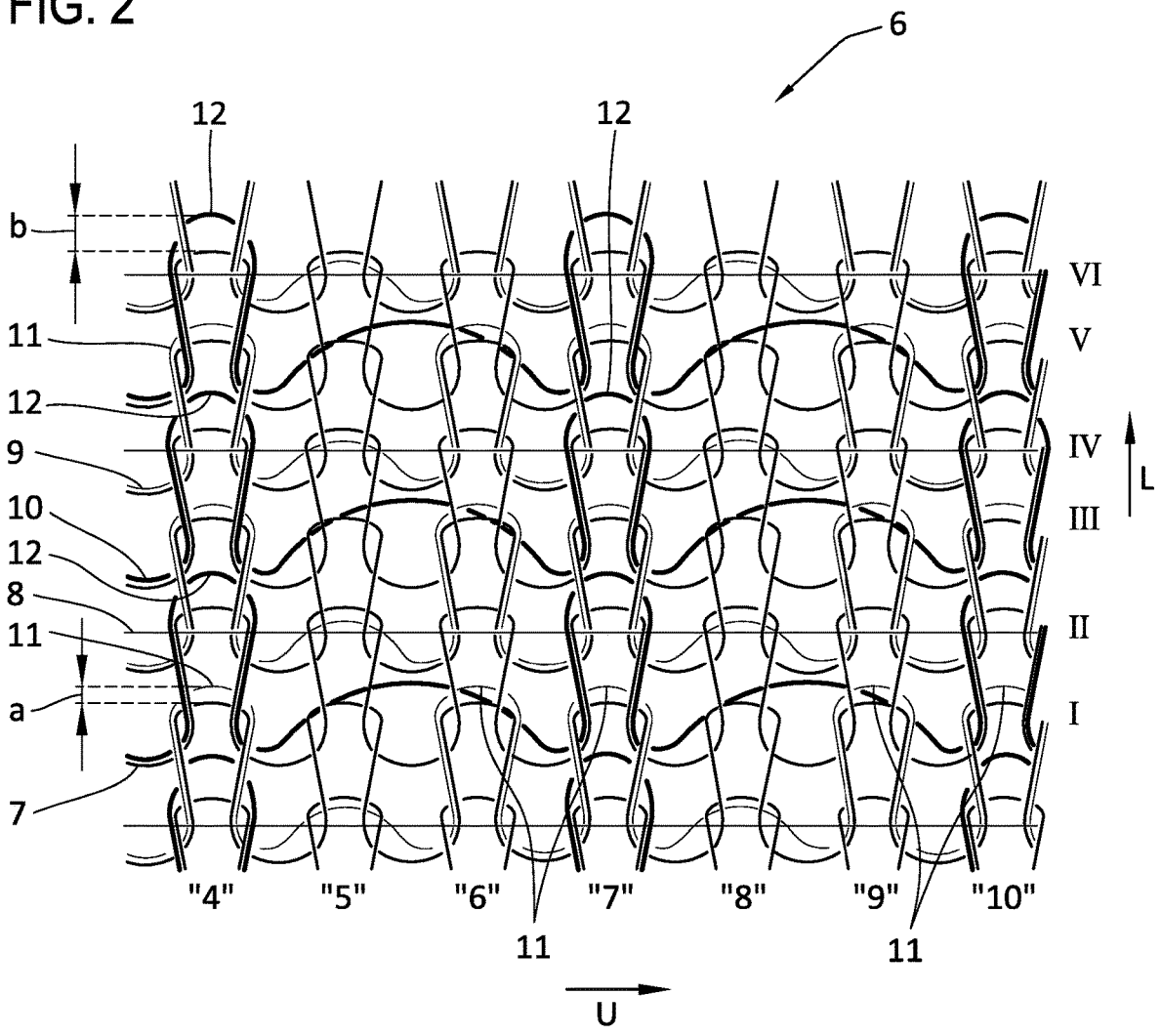
FIG. 2 shows an in-principle illustration of a loop structure in the region of the plush or cushion zone of the stocking from FIG. 1.

An example of a loop structure for configuring such a plush or cushioning region 6 is shown in FIG. 2. A plurality of stitch courses I-VI which are in a sequence in the longitudinal direction L of the knitted fabric are shown, wherein each stitch course I-VI is composed of a multiplicity of individual stitches which are successive in the circumferential direction U. In the circumferential direction, seven needles (in an exemplary manner identified by the numerals 4 to 10) of the circular knitting machine, consequently thus seven stitch wales, when viewed in the longitudinal direction of the knitted fabric are illustrated in an exemplary manner.

The basic knitted fabric thread 7 shown is shown as a solid black line. The basic knitted fabric here in an exemplary manner is embodied as a right/left knitted fabric. The basic knitted fabric thread 7 can be an arbitrary thread from a man-made or natural fiber.

Furthermore shown is a weft thread 8, preferably from an elastic material such as elastane or similar, which in the example shown is inserted into each second stitch course, here the stitch courses II, IV, and VI.

In order for the actual cushioning and the dissimilar plush loops to be configured, a first plush thread 9 and a second plush thread 10 are knitted into the basic knitted fabric 5, or are plated on selected stitches of the basic knitted fabric thread 7, respectively. The first plush thread 9 forms shorter plush loops 11, while the second plush thread 10 forms longer plush loops 12. This means that the first plush loops 11 project from the plane of the basic knitted fabric 5 to a lesser extent than the second, longer plush loops 12.

The dissimilar plush loop lengths in FIG. 2 are shown with additional length or spacing indications. The length of the shorter plush loops 11 is indicated by "a", the length of the longer plush loops 12 being indicated by "b". The respective lengths "a", "b" are measured from the upper edge or the upper side of the basic knitted fabric thread 7 to the lower edge or the lower side of the respective plush thread 9, 10 in the respective plush loop 11, 12, so to speak.

Only one plush thread 9, 10 is in each case incorporated in one stitch course I-VI in the example shown. The first plush thread 9 is incorporated in the stitch courses I, III, and V, while the second plush thread 10 is incorporated in the stitch courses II, IV, and VI.

In the example shown, the first plush thread 9 which can be, for example, a PA thread, preferably textured, optionally highly elastic, and embodied with or without a core, is knitted as a 2:1 plush such that plush loops 11 are formed on two mutually adjacent needles, when viewed in the circumferential direction, followed by an empty needle in which the first plush thread 9 is only inserted, followed in turn by two plush loops 11, etc. In the exemplary embodiment shown, the two plush loops 11 in the stitch courses I, III, and V are configured, for example, on the needles "6", "7", or on the corresponding stitch wales, respectively, while the first plush thread 9 floats over the needle "8", whereupon two plush loops 11 are in turn configured on the needles "9", "10", while the plush thread 9 in turn floats on the subsequent needle (not shown here), etc.

In contrast, the second plush thread 10 which is, for example, a natural thread, in particular wool, is knitted as a 1:2 plush. Consequently, the respective plush loop 12 lies so as to be plated on a first needle, or on a first basic knitted fabric stitch, respectively, whereupon no second plush loop 11 is formed on the two subsequent needles, or basic knitted fabric stitches, respectively, when viewed in the circumferential direction; rather, the second plush thread 10 here merely lies in the basic knitted fabric, while a plush loop 12 is in turn configured on the subsequent needle. In an exemplary manner, a second, longer plush loop 12 here is configured on the needles "4", or on the corresponding stitch wale, respectively (cf. for example the stitch course IV), while the second plush thread merely lies in the basic knitted fabric on the needles "5", "6", or on the corresponding stitch wales, respectively. However, a second, longer plush loop 12 is in turn formed on the needle "7", while the second plush thread 10 in turn is merely inserted on the subsequent needles "8", "9", and a longer, second plush loop 12 is in turn formed on the needle 10.

The weft thread 8 runs as a catch thread and a floating thread through the basic knitted fabric. Said weft thread 8 in the example shown lies in the stitch courses II, IV, and VI, thus in those stitch courses in which the first knitted fabric thread 9 is also routed. Said weft thread 8 runs as a catch thread on the same needles as the first plush thread 9, which leads to the weft thread 8 pushing the first plush thread 9 and thus the first plush loops 11 formed by way of the latter into the basic knitted fabric.

In the case of the exemplary stitch shown and of the different knitting patterns of the two plush threads 9, 10 (2:1 plush in the case of the plush thread 9, and 1:2 plush in the case of the plush thread 10) the result is consequently a dissimilar number of first and second plush legs 11, 12. The number of first plush loops 11 is significantly higher than the number of second plush loops 12. It is to be noted that the selected knitting patterns of the plush threads 9, 10 are merely exemplary; said knitting patterns can of course also be selected so as to be different, by way of which the respective number of plush loops and thus also the density of the plush loops can be varied.

In the example shown, the plush threads 9, 10 consequently alternate from one stitch course to another. By virtue of the dissimilar knitting patterns, stitch wales in which the two plush loops 11, 12 are present in a mutually alternating manner result, for example the stitch wales on the needles "4", "7", and "10". In contrast, there are also stitch wales in which there are no plush loops, for example the stitch wales on the needles "5", "8". There are furthermore stitch wales in which only first plush loops 11 are present, for example the stitch wales "6" and "9".

Since the plush loops 11, 12 are of dissimilar length, dissimilar layers or planes are consequently configured on the finished knitted article 1. The one layer, here in an exemplary manner the external knitted fabric layer or knitted fabric plane, is formed by the basic knitted fabric. The first and the second plush loops 11, 12 then project toward the left knitted goods side, thus so as to be directed toward the side of the wearer. The plush loops 11, since the latter are shorter than the plush loops 12, form a second plane or an intermediate plane which projects somewhat from the plane of the basic knitted fabric. So as to be directed even further toward the wearer, so as to bear directly on the skin of the wearer, the third knitted fabric layer or knitted fabric plane having the second, long plush loops 12 is formed, said third knitted fabric layer or knitted fabric plane in relation to the worn position, quasi forming the internal knitted article plane.

If wool is used as described as the second plush thread, a very pleasant wearing experience in conjunction with positive cushioning can be imparted by way of the inner plush plane that is formed by the longer, higher plush loops 12. The properties of wool are inter alia a positive retention of heat, and a positive equalization of temperature, wool being breathable as well as dirt and water repellent. Wool also has a certain inherent antibacterial protection.

The shorter plush loops 11 which form the intermediate plane of course also facilitate cushioning. Said shorter plush loops by way of the weft thread are in part also pushed somewhat into the basic knitted fabric. PA which has a low moisture absorption capability is preferably used as the fiber material. By way of the capillary effect, moisture that arises, for example by sweating, can be transported to the outside by way of the PA plush loops 11, thus by way of the intermediate plane, through the knitted article 1, respectively through the basic knitted fabric 5, this thus enabling a positive climate effect.

The two plush threads 9, 10 can be used having identical thicknesses, or else can be used having dissimilar thicknesses. For example, in order for the density of the plane that is formed from the second plush loops 12 to be increased, a thicker wool thread can be used such that each plush loop 12 is significantly thicker than a plush loop 11. This means that the volume of wool on the internal side of the knitted article can be increased by way hereof, consequently providing more material that in haptic terms is more pleasant, in conjunction simultaneously with a lower number of plush loops. This also facilitates cushioning. A significantly thinner thread, for example as a PA thread, can be used as the first plush thread 9, said first plush thread 9 of course facilitating cushioning, on the one hand, but primarily serving the transportation of moisture, respectively climatization, on the other hand. Said first plush thread 9 is present in a comparatively high number of plush loops so as to offer a high transportation surface.

While specific embodiments of the invention have been shown and described in detail to illustrate the inventive principles, it will be understood that the invention may be embodied otherwise without departing from such principles.

I claim:

1. A knitted article, having a basic knitted fabric which is knitted from at least one basic knitted fabric thread, and at least two plush threads which are plated on the basic knitted fabric thread to form plush stitches which configure first and second plush loops, wherein the first and the second plush loops have dissimilar heights, wherein at least one zone is formed in which the first and the second plush loops are collectively present, wherein at least some of the plush stitches with the first and the second plush loops lie in common stitch wales.

2. The knitted article according to claim 1, wherein the two plush threads are composed of dissimilar materials or have dissimilar properties.

3. The knitted article according to claim 2, wherein the two plush threads have dissimilar shrinking behaviors in a thermal treatment, or dissimilar elasticities, or dissimilar surfaces, or dissimilar thicknesses.

4. The knitted article according to claim 2, wherein the one plush thread is from a man-made fiber and the other plush thread is from a natural fiber.

5. The knitted article according to claim 1, wherein the two plush threads are incorporated in separate stitch courses of the basic knitted fabric.

6. The knitted article according to claim 5, wherein the two plush threads are incorporated in successive stitch courses, or in that in each case at least one stitch course that is not provided with a plush thread is provided between the stitch courses, or in that a plurality of successive stitch courses that are provided with the first plush thread alternate with a plurality of successive stitch courses that are provided with the second plush thread or at least one stitch course that is not occupied by any plush thread is provided between said respective successive stitch courses.

7. The knitted article according to claim 5, wherein the plush threads run in each case helically through the basic knitted fabric, or in that the plush threads in the respective stitch course run in the circumferential direction only in portions.

8. The knitted article according to claim 1, wherein the first and the second plush thread are incorporated into the basic knitted fabric in the same stitch course, so as to in each case run in the circumferential direction in portions.

9. The knitted article according to claim 8, wherein, when viewed in the circumferential direction, a plurality of portions that are formed from the first and from the second plush thread alternate with one another.

10. The knitted article according to claim 1, wherein the number of the first plush loops and the number of the second plush loops are identical or dissimilar.

11. The knitted article according to claim 10, wherein the one plush thread is knitted in the form of a 2:1 plush, and the other plush thread is knitted in the form of a 1:2 plush.

12. The knitted article according to claim 1, wherein the first and the second plush loops project toward the same side of the basic knitted fabric, or in that the first plush loops project toward the one side of the basic knitted fabric and the second plush loops project toward the other side of the basic knitted fabric.

13. The knitted article according to claim 1, wherein at least one weft thread is inserted into the basic knitted fabric.

14. The knitted article according to claim 13, wherein the weft thread is incorporated at least into those stitch courses in which the plush thread that forms the lower plush loops is incorporated.

15. The knitted article according to claim 1, wherein said knitted article is a stocking and the plush loops form an at least local cushioning.

16. A method for producing a knitted article according to claim 1, wherein a basic knitted fabric is knitted using at least one basic knitted fabric thread, at least two plush threads being knitted into said basic knitted fabric to form plush stitches while forming first and second plush loops, wherein either the first and the second plush loops are knitted so as to be of dissimilar heights, or wherein the first and the second plush loops are knitted so as to be of identical height and the knitted fabric subsequently is post-treated such that the one plush thread shrinks while shortening the plush loops that are knitted therefrom, wherein at least one zone is formed in which the first and second plush loops are collectively present, wherein at least some of the plush stitches with the first and the second plush loops lie in common stitch wales.

17. The method according to claim 16, wherein the knitted fabric is thermally post-treated.

18. The knitted article according to claim 4, wherein the man-made fiber is PA.

19. The knitted article according to claim 4, wherein the natural fiber is wool.

20. The method according to claim 17, wherein the knitted fabric is thermally post-treated by water, steam, or radiation.

* * * * *